US007231968B2

(12) United States Patent
Owens

(10) Patent No.: US 7,231,968 B2
(45) Date of Patent: Jun. 19, 2007

(54) WELL CAP SYSTEMS

(76) Inventor: Eric Owens, 360 W. Industrial Dr., Chino Valley, AZ (US) 86323-5360

( * ) Notice: Subject to any disclaimer, the term of this patent is extended or adjusted under 35 U.S.C. 154(b) by 118 days.

(21) Appl. No.: 10/784,087

(22) Filed: Feb. 19, 2004

(65) Prior Publication Data

US 2004/0168795 A1 Sep. 2, 2004

Related U.S. Application Data

(60) Provisional application No. 60/450,784, filed on Feb. 28, 2003.

(51) Int. Cl.
*E21B 33/04* (2006.01)

(52) U.S. Cl. ..... 166/75.13; 166/92.1; 166/93.1

(58) Field of Classification Search ..... None
See application file for complete search history.

(56) References Cited

U.S. PATENT DOCUMENTS 4,214,628 A * 7/1980 Botts ..... 166/90.1

* cited by examiner

*Primary Examiner*—Zakiya W. Bates
(74) *Attorney, Agent, or Firm*—Stone Volk Patent Group; Martin L. Stoneman

(57) ABSTRACT

A system for capping the upper opening of a well having an accommodation for a remotely-located control device. More specifically, a well cap system for a water-well having a pipe casing that permits one or more well control apparatus to be located within the well cap. The system is a two-part assembly, comprising a base and hollow cover, both arranged to be supported by the pipe casing. Further, a constant pressure well system utilizing the water-well cap system.

25 Claims, 4 Drawing Sheets

WELL CAP SYSTEMS

CROSS-REFERENCE TO RELATED APPLICATION

The present application claims the benefit of and is related to prior provisional application Ser. No. 60/450,784, filed Feb. 28, 2003, entitled "WELL CAP SYSTEM", the cootents of which are incorporated herein by this reference and are not admitted to be prior art with respect to the present inve-ution by the mention in this cross-reference section.

BACKGROUND

This invention relates to well cap systems. More particularly, it relates to a system for capping at least one well pipe having at least one upper opening and at least one interior portion containing at least one controllable apparatus.

Often, building structures are supplied with water generated from a local groundwater well, most often where municipal or commercial water supplies are unavailable or prohibitive in cost to access. Typically, a water well consists of an essentially vertical hole or shaft, drilled into the earth to access a subterranean groundwater supply. This shaft (also known as a "well bore" or "borehole") may extend several hundred feet before reaching a water-bearing formation. Generally, at least the upper portion of the drilled hole is lined with a well casing consisting of a rigid pipe. The upper open end of the well casing is typically terminated above the ground and is used to access the interior of the well, for example, to place or service an in-well pump.

In current "constant pressure" water-well systems, a submersible pump located at the bottom of the well delivers pressurized water to a remotely-located structure through a water line extending between the well and the structure. Typically, a pump controller, located at the structure, monitors water pressure within the water-well system and regulates pump output to maintain desired water pressures under various conditions of water demand. Thus, the controller needs to be accessed/maintained at a different location than the pump or other equipment at the well site.

Usually, the pump controller and related apparatus are remotely located within a portion of a building some distance from the well. Power and control wiring must necessarily extend the distance between the controller within the building and the pump. Further, installation, monitoring, and service of completed well systems require that the building be at an appropriate point of construction and accessible to the well system installer. During installation, the well system installer must closely coordinate the well installation work with the operation and/or construction of a building or other closable structure access to which typically requires permissions and/or appointments. Thus, continued monitoring and maintenance of the system requires further coordination with the building owner or operator to gain access to the remotely located controller equipment.

Therefore, a need exists for an improved well system which overcomes the prior problems and which permits installation, operation, and monitoring of a well system without the burdensome issues of coordination that currently exist.

OBJECTS OF THE INVENTION

A primary object and feature of the present invention is to overcome the above-mentioned problems and fulfill the above-mentioned needs.

It is a further object and feature of the present invention to provide a well cap system that reduces the need to utilize and access a remote structure during well installation, monitoring, and maintenance operations.

It is a further object and feature of the present invention to provide such a system that reduces the time and materials required to install a well system by locating a portion of the well controls at the well-site.

It is a further object and feature of the present invention to provide such a system that protectively encloses the top of the well casing and the local well control system.

It is a further object and feature of the present invention to provide such a system that provides a single well cap adaptable to a range of well casing sizes.

It is an additional primary object and feature of the present invention to provide such a system that is efficient, inexpensive and handy. Other objects and features of this invention will become apparent with reference to the following descriptions.

SUMMARY OF THE INVENTION

In accordance with a preferred embodiment hereof, this invention provides a system for capping at least one well pipe having at least one upper opening and at least one interior portion containing at least one controllable apparatus, the at least one controllable apparatus controlled by at least one local controller device, such system comprising: well capping means for capping the at least one well pipe; wherein such well capping means comprises, closure means for substantially closing the at least one upper opening, protective cover means for protectively covering the at least one local controller, and support means for supporting the at least one local control system within such protective cover means.

In accordance with another preferred embodiment hereof, this invention provides a system for capping at least one well pipe having at least one upper opening and at least one interior portion containing at least one controllable apparatus, the at least one controllable apparatus controlled by at least one local controller device, such system comprising: at least one well cap to cap the at least one well pipe; wherein such at least one well cap comprises at least one closure adapted to substantially close the at least one upper opening, at least one protective cover adapted to protectively cover the at least one local controller device, and at least one support to support the at least one local controller device within such at least one protective cover. Moreover, it provides such a system wherein such at least one well cap is substantially supported by the at least one well pipe. Additionally, it provides such a system wherein such at least one closure comprises at least one mount adapted to mount such at least one closure to the at least one well pipe. Also, it provides such a system wherein: such at least one mount comprises at least one size-adapter to adapt such at least one closure to at least two such well pipes having different sizes; and such at least one size-adapter comprises at least one first one and at least one second one of such at least one mounts, such at least one first one being adapted to fit at least one such well pipe having a first size, and such at least one second one being adapted to fit at least one such well pipe having a second size different from such first size. In addition, it provides such a system wherein such at least one size-adapter adapts such at least one closure to such at least one well pipe having a nominal diameter of five-inches. And, it provides such a system wherein such at least one size-adapter adapts such at least one closure to such at least one well pipe having a nominal diameter of six-inches. Further, it provides such a system wherein such at least one size-adapter adapts such at least one closure to such at least one well pipe having an outer diameter of about seven inches. Even further, it provides such a system wherein such at least one size-adapter adapts such at least one closure to such at least one well pipe having a nominal diameter of eight-inches.

Moreover, it provides such a system wherein: such at least one closure further comprises an essentially planar member having at least one first face, at least one second face, and a peripheral edge; such at least one mount comprises at least one collar projecting outwardly from such at least one second face; and such at least one collar is adapted to engage at least one portion of the at least one well pipe. Additionally, it provides such a system wherein such at least one closure comprises a nested arrangement of at least two of such at least one collars. Also, it provides such a system wherein such at least one protective cover comprises: at least one peripheral wall; wherein such at least one peripheral wall defines at least one hollow cavity adapted to contain the at least one local controller device; and wherein such at least one peripheral wall comprises at least one access opening, having at least one inner peripheral edge, to permit access to such at least one hollow cavity. In addition, it provides such a system wherein such at least one well cap further comprises at least one electrical passage structured and arranged to pass at least one electrical conductor from within such at least one hollow cavity to at least one point external to such at least one hollow cavity. And, it provides such a system wherein such at least one electrical passage comprises at least one threaded aperture. Further, it provides such a system wherein such at least one well cap further comprises: at least one vent to provide atmospheric venting between the at least one interior portion of the at least one well pipe, and at least one environment exterior to the at least one interior portion of the at least one well pipe; wherein such at least one vent comprises at least one channel to channel vented atmosphere from the at least one interior portion; and wherein such at least one channel comprises at least one isolator structured and arranged to isolate the vented atmosphere from the at least one local controller device.

Even further, it provides such a system further comprising: at least one first interlocker; and at least one second interlocker; wherein such at least one second interlocker is adapted to interlock with such at least one first interlocker; wherein such at least one first interlocker comprises such at least one closure; wherein such at least one second interlocker comprises such at least one protective cover; and wherein interlocking of such at least one first interlocker and such at least one second interlocker removably retains such at least one protective cover to such at least one base. Moreover, it provides such a system wherein: such at least one protective cover further comprises at least one first aperture adapted to pass at least one portion of at least one padlock shackle; such at least one closure further comprises at least one second aperture to pass the at least one portion of the at least one padlock shackle; and such removable retention of such at least one protective cover adjacent such at least one closure by such interlocking permits at least one position of alignment between such at least one first aperture and such at least one second aperture to permit passage of the at least one portion of the at least one padlock shackle through both such at least one first aperture and such at least one second aperture. Additionally, it provides such a system wherein such at least one peripheral wall comprises at least one data transfer port to permit at least one transfer of data between the at least one local controlling device within such at least one hollow cavity and at least one data transfer device external to such at least one well cap. Also, it provides such a system wherein: such at least one data transfer port comprises of such at least one peripheral wall; such at least one transparent portion is structured and arranged to provide at least one signal view of at least one portion of the at least one local controller device even when such at least one protective cover is removably retained on such at least one base. In addition, it provides such a system wherein: such at least one first interlocker comprises at least one peripheral notch formed within such at least one peripheral edge of such at least one closure; such at least one second interlocker comprises at least one tab projecting from such at least one inner peripheral edge of such at least one protective cover; such at least one peripheral notch is adapted to permit such at least one tab to pass through such at least one closure from a position adjacent such at least one first face, to a position adjacent such at least one second face; and at least one rotation of such at least one protective cover relative to such at least one closure, while such at least one tab is in the position adjacent such at least one second face, removably retains such at least one protective cover on such at least one base member. And, it provides such a system wherein such at least one well cap substantially comprises at least one thermoplastic. Further, it provides such a system wherein such at least one well cap is substantially comprised of aluminum. Even further, it provides such a system wherein such at least one well cap is substantially comprised of stainless steel. Even further, it provides such a system wherein such at least one well cap is substantially comprised of brass.

In accordance with another preferred embodiment hereof, this invention provides a system for supplying a flow of water, from at least one well having at least one well pipe, at least one upper well pipe opening and at least one pipe interior, to at least one structure having a pressurized water supply, comprising, in combination: at least one pump to pump water from the at least one pipe interior; at least one local control system to control such at least one pump; at least one well cap, comprising at least one internal hollow, to cap the at least one upper well pipe opening; wherein such at least one local control system is located essentially within such at least one internal hollow of such at least one well cap. Even further, it provides such a system wherein such at least one local control system comprises at least one local pressure sensor for monitoring the pressure of the flow of water delivered from such at least one pump.

Even further, it provides such a system further comprising such at least one well having at least one well pipe. Even further, it provides such a system wherein such at least one local pressure sensor is located within such at least one well pipe of such at least one well. Even further, it provides such a system further comprising at least one water transfer system to transfer the flow of water from such at least one well to the at least one structure having at least one pressurized water supply. Even further, it provides such a system further comprising such at least one structure having at least one pressurized water supply. Even further, it provides such a system wherein such at least one well and such at least one local control system are structured and arranged to permit maintenance of such system without entry to the at least one structure. Even further, it provides such a system wherein such at least one local control system comprises the sole controller of such at least one pump within such system.

DETAILED DESCRIPTION OF A PREFERRED EMBODIMENT OF THE INVENTION

Figure 1:
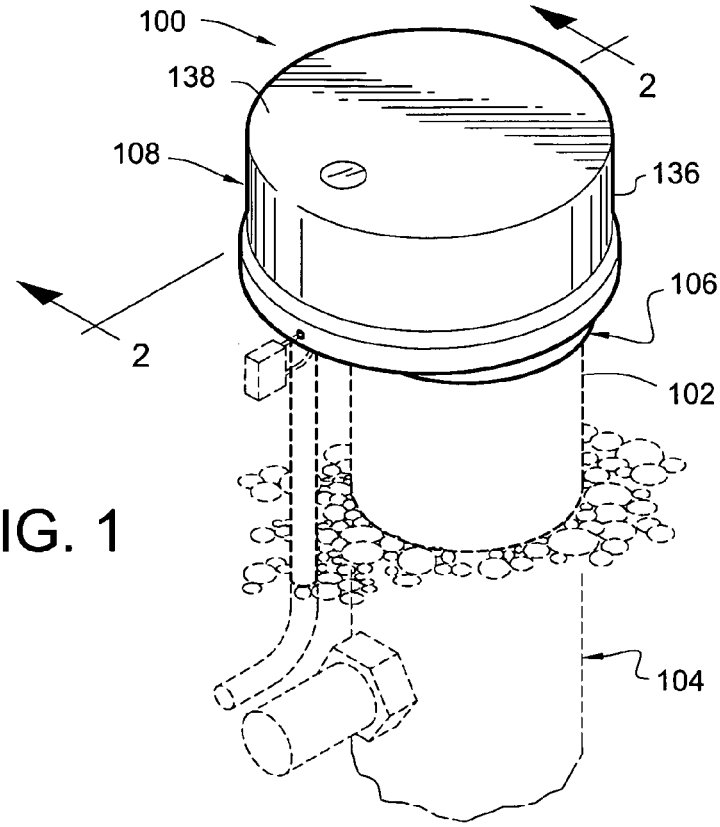
FIG. 1 is a perspective view of a well cap system installed on the above grade portion of a well casing, according to a preferred embodiment of the present invention.

FIG. 1 is a perspective view of well cap system 100 installed on the above grade portion 102 of well casing 104 (shown in dashed lines), according to a preferred embodiment of the present invention. Preferably, well cap system 100 is substantially supported by well casing 104, as shown. Preferably, well cap system 100 (at least herein embodying well capping means for capping the at least one well pipe; and further at least herein embodying at least one well cap to cap the at least one well pipe) comprises two principal components: a closure member 106, and a removable protective cover 108, supported by closure member 106, as shown.

Figure 2:
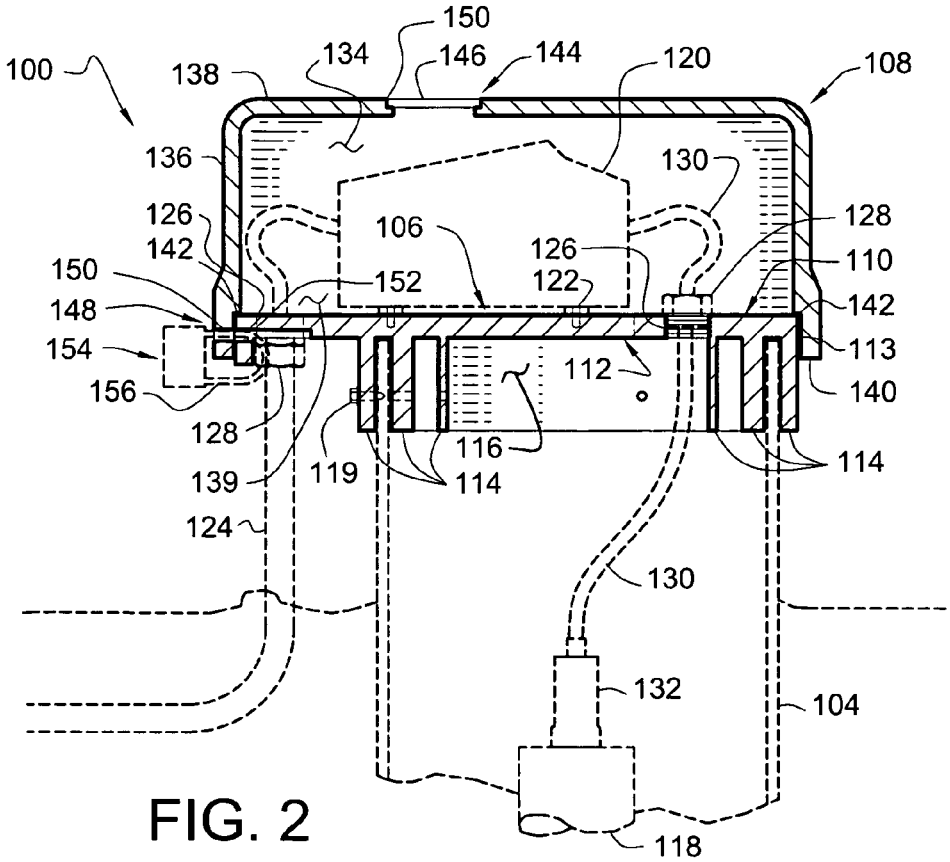
FIG. 2 is a sectional view through the section 2—2 of FIG. 1 illustrating internal features of the well cap system.

FIG. 2 is the sectional view 2—2 of FIG. 1 illustrating internal features of well cap system 100. FIG. 2 diagrammatically illustrates a typical application of well cap system 100 installed on a well having a controllable apparatus 118 (shown in dashed lines), preferably and typically a pump, and an associated controller 120 (also shown in dashed lines). Upon reading the teachings of this specification, those with ordinary skill in the art will now understand that, under appropriate circumstances, considering issues such as well type, intended use, local regulatory requirements, etc., other controllable apparatus arrangements may suffice; for example, controllable apparatus 118 may also comprise a valve, motor, monitor, etc.

Preferably, closure member 106 (at least herein embodying closure means for substantially closing the at least one upper opening) comprises an essentially planar disk having an upper face 110 (at least herein embodying at least one first face), a lower face 112 (at least herein embodying at least one second face), and perimeter edge 113 (at least herein embodying a peripheral edge), as shown. Lower face 112 preferably includes a downwardly-projecting mounting collar 114 (at least herein embodying wherein such at least one closure comprises at least one mount adapted to mount such at least one closure to the at least one well pipe; and further comprising at least one collar projecting outwardly from such at least one second face) adapted to fit over the upper opening 116 of well casing 104, as shown. Most preferably, closure member 106 comprises several nested mounting collars 114 to permit a single well cap system 100 to adapt to various diameter well casings 104 (shown in dashed lines). Preferably, one or more removable mechanical fasteners, such as screw 119, are used to retain well cap system 100 on well casing 104, as shown. Screw 119 preferably threads through mounting collar 114 and engages well casing 104, as shown. Preferably, mounting collar 114 is pre-drilled to permit screw 119 to pass, as shown. Upon reading the teachings of this specification, those with ordinary skill in the art will now understand that, under appropriate circumstances, considering issues such as cost, ease of installation, required security at the well site etc., other fastening arrangements may suffice, such as, for example, friction-fitting, bolting, clamping, etc.

Upper face 110 (at least herein embodying support means for supporting the at least one local control system within such protective cover means; and further at least herein embodying at least one support to support the at least one local controller device within such at least one protective cover) of closure member 106 preferably serves as a support and mounting surface for controller 120, as shown. The preferred thickness of closure member 106 between upper face 110 and lower face 112 is about one-half inch, providing closure member 106 with suitable structural rigidity to permit support of controllers 120 of various weights and mounting requirements. In the present example of FIG. 2, closure member 106 has been drilled through upper face 106 and tapped to provide threaded sockets 122 for securely mounting controller 120 to closure member 106, as shown. Closure member 106 further preferably comprises one or more threaded openings 126 to permit electrical power and control circuits to pass through closure member 106, as shown. In the example of FIG. 2, threaded opening 126 (at least herein embodying wherein such at least one well cap further comprises at least one electrical passage structured and arranged to pass at least one electrical conductor from within such at least one hollow cavity to at least one point external to such at least one hollow cavity) is fitted with threaded fitting 128 adapted to provide a termination point for supply conduit 124. Also visible in the sectional view of FIG. 2 is a second preferred threaded opening 126 and threaded fitting 128 that permits control wiring 130 to route from controller 120 through closure member 106 to controllable apparatus 118 and/or secondary apparatus 132, as shown.

Preferably, controller 120 is protectively housed within cavity 134 formed by the cap-like protective cover 108 (at least herein embodying protective covering means for protectively covering the at least one local controller; and further at least herein embodying at least one protective cover adapted to protectively cover the at least one local controller device), as shown. Preferably, protective cover 108 comprises a unitary, hollow, member, as shown. Preferably, protective cover 108 comprises a generally cylindrical-shaped enclosure having a continuous sidewall 136, projecting from a generally circular integral top 138, as shown. Preferably, lower perimeter edge 140 of sidewall 136 defines opening 139 (at least herein embodying at least one peripheral wall defining at least one hollow cavity adapted to contain the at least one local controller device; and further at least herein embodying wherein such at least one peripheral wall comprises at least one access opening, having at least one inner peripheral edge, to permit access to such at least one hollow cavity) preferably sized to mount over the outer perimeter edge 113 of closure member 106, as shown. The lower interior face of sidewall 136 preferably comprises an integral annular offset 142 adapted to rest on upper face 110 of closure member 106, as shown.

Lower perimeter edge 140 of sidewall 136 preferably extends below the level of lower face 112, as shown, to permit effective shedding of rainwater.

Preferably, well cap system 100 comprises view-port 144, preferably consisting of view aperture 150 through circular top 138, as shown. Preferably, view-port 144 is fitted with transparent cover 146, as shown. In use, view-port 144 permits a view from the exterior of well cap system 100 to a portion of controller 120 without removing protective cover 108. The preferred use of view-port 144 permits a reading of the status of controller 120 by means of a display panel or infrared data transfer means. It is preferred that transparent cover 146 is constructed of a rigid plastic, such as polycarbonate. Upon reading the teachings of this specification, those with ordinary skill in the art will now understand that, under appropriate circumstances, considering issues such as cost and application, etc., other transparent and/or translucent materials may suffice, such as, for example, glass, styrene, etc.

Well cap system 100 preferably includes a security padlock accommodation 148 for securing protective cover 108 to closure member 106, thus preventing unauthorized access to controller 120, as shown. Preferably, security padlock accommodation 148 comprises first lock aperture 150 within protective cover 108, and second lock aperture 152 within closure member 106, as shown. Preferably, both first lock aperture 150 and second lock aperture 152 are adapted to pass the shackle 156 of padlock 154, as shown. The preferred arrangement of second lock aperture 152 of security padlock accommodation 148 is more clearly visible in FIG. 3 as described below.

Preferably, protective cover 108 and closure member 106 allow for at least one position of alignment between first lock aperture 150 and second lock aperture 152 to permit a simultaneous passage of padlock shackle 156, as shown.

Figures 3A, 3B:
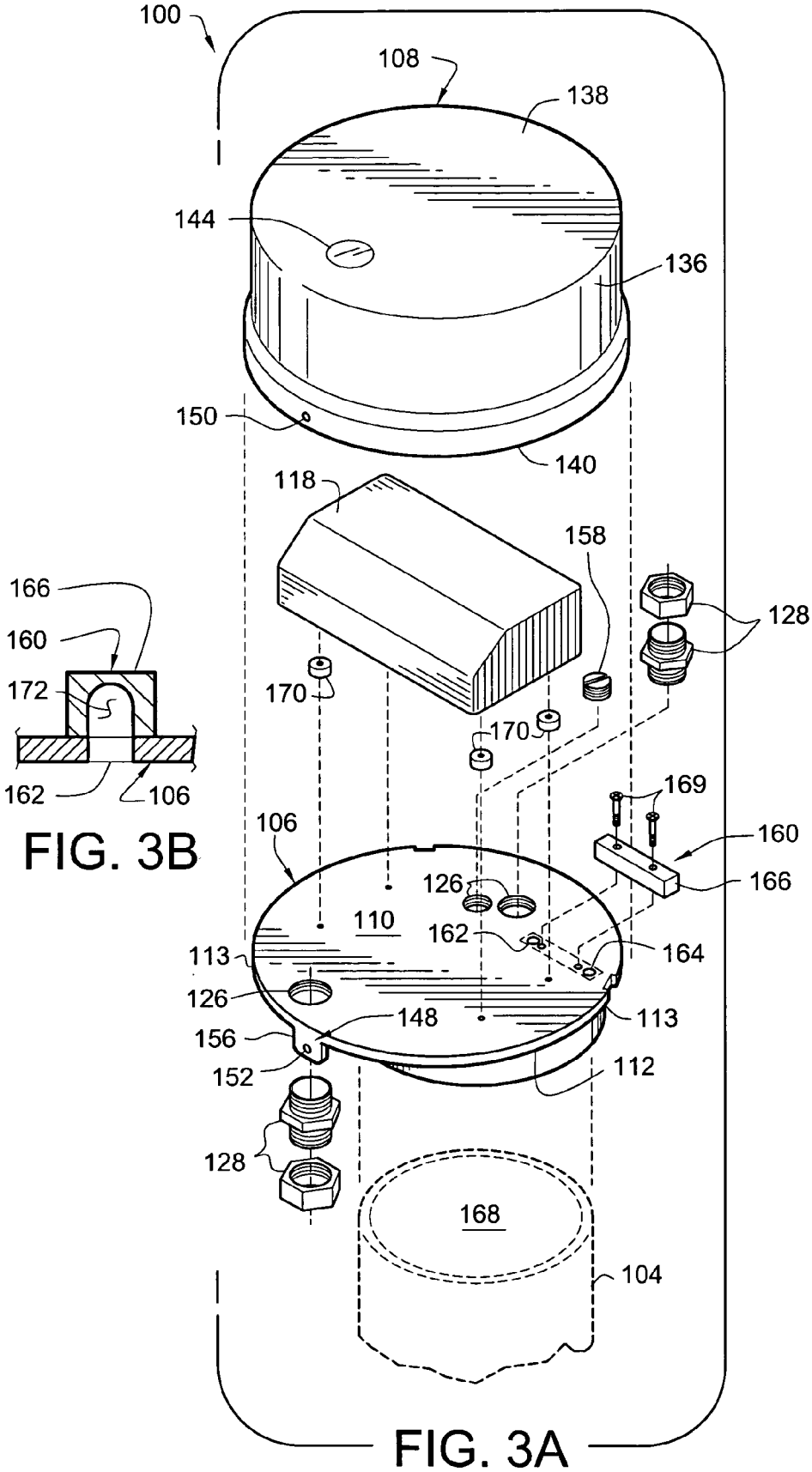
FIG. 3A is an exploded view of the well cap system, according to the preferred embodiment of FIG. 1 and FIG. 2.
FIG. 3B is a sectional view through a vent assembly of the well cap system, according to the preferred embodiment of FIG. 1 through FIG. 3.

FIG. 3A is an exploded view of the well cap system 100, according to the preferred embodiment of FIG. 1 and FIG. 2. The preferred arrangement of second lock aperture 152 of security padlock accommodation 148 (as illustrated in FIG. 2) is clearly visible in FIG. 3A. Preferably, second lock aperture 152 is located within tongue member 156, projecting downwardly from perimeter edge 113, as shown. The corresponding first lock aperture 150 is visibly located at lower perimeter edge 140 of protective cover 108. In the preferred embodiment of FIG. 1 through FIG. 3A, closure member 106 contains three threaded openings 126, as shown. Upon reading the teachings of this specification, those with ordinary skill in the art will now understand that, under appropriate circumstances, considering issues such as specific applications, apparatus requirements, etc., other quantities and arrangements of apertures, such as, for example, the inclusion of unassigned apertures, spare apertures, etc., may suffice. Preferably, unused threaded openings 126 are filled with blanking inserts 158, as shown. Under appropriate circumstances, such as to expedite conduit installation, threaded openings 126 may be supplied with one or more threaded fittings 128 pre-installed by the supplier or manufacturer.

Preferably, well cap system 100 is adapted to permit controlled atmospheric venting between the interior of the well casing and the outside environment. To accommodate atmospheric venting of well casing 104, closure member 106 preferably comprises vent assembly 160 comprising a first vent aperture 162, second vent aperture 164 and venting channel 166, as shown. Preferably, first venting aperture 162 penetrates closure member 106 at a location permitting first venting aperture 162 to be in fluid communication with the interior portion 168 of well casing 104 (while closure member 106 is installed). Preferably, second vent aperture 164 also penetrates closure member 106, but is located such that one end is in fluid communication with the environment exterior to the interior portion 168 of well casing 104. Preferably, venting channel 166 acts as an air passage (see FIG. 3B), bridging between first venting aperture 162 and second vent aperture 164, as shown. Preferably, venting channel 166 is fastened to closure member 106 using threaded fasteners 169, as shown. Upon reading the teachings of this specification, those with ordinary skill in the art will now understand that, under appropriate circumstances, considering issues such as fabrication cost material choice, etc., other venting arrangements may suffice, such as, for example, venting channel 166 may be integral to closure member 106.

Furthermore, upon reading the teachings of this specification, those with ordinary skill in the art will now understand that, under appropriate circumstances, considering such issues as controller function and availability, other controller sizes, shapes and mounting means may suffice. Moreover, under appropriate circumstances, controllable apparatus 118 may preferably include such proprietary components as mounting standoffs 170, mounting anchors, etc.

FIG. 3B is a sectional view through vent assembly 160 (at least herein embodying at least one vent to provide atmospheric venting between the at least one interior portion of the at least one well pipe, and an environment exterior to the at least one interior portion of the at least one well pipe), according to the preferred embodiment of FIG. 1 through FIG. 3A. Referring specifically to FIG. 3B with continued reference to FIG. 3A, preferably venting channel 166 (at least herein embodying at least one channel to channel vented atmosphere from the at least one interior portion) comprises a hollow, substantially rectangular U-shaped member, as shown. Preferably, air moving between first vent aperture 162 and second vent aperture 164 passes through hollow cavity 172 of venting channel 166 that is preferably positioned over the vent apertures, as shown. Venting channel 166 preferably isolates moist air within well casing 104 from and essentially keeps that moist air from directly reaching controller 120 (at least herein embodying at least one isolator structured and arranged to isolate the vented atmosphere from the at least one local controller device). Upon reading the teachings of this specification, those with ordinary skill in the art will now understand that, under appropriate circumstances, considering issues such as intended environment, service duration, etc., other venting arrangements may suffice, such as, for example, hollow cavity 172 may include such preferred features as screening or packing to prevent entry of insects or other unwanted materials into well casing 104.

Figure 4:
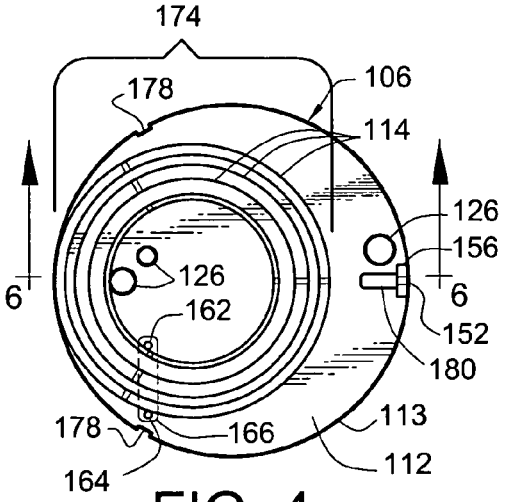
FIG. 4 is a top view of a base member of the well cap system, according to the preferred embodiment of FIG. 3A.
Figure 5:
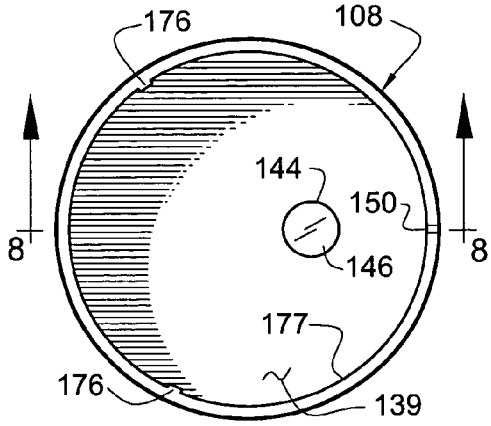
FIG. 5 is a bottom view of a protective cover of the well cap system, according to the preferred embodiment of FIG. 3A.

In reference to FIG. 4 and FIG. 5, FIG. 4 is a bottom view of closure member 106, according to the preferred embodiment of FIG. 3A. FIG. 5 is a bottom view of protective cover 108, according to the preferred embodiment of FIG. 3A. Preferably, well cap system 100 comprises an arrangement that permits protective cover 108 to be removably retained on closure member 106 by means of asymmetrically arranged interlocking tabs 176 located along the interior edge 177 of opening 139, and complementary peripheral notches 178 (at least herein embodying at least one first interlocker) positioned along perimeter edge 113, as shown. Preferably, peripheral notches 178 are adapted to permit interlocking tabs 176 (at least herein embodying at least one second interlocker wherein such at least one second interlocker is adapted to interlock with such at least one first interlocker) to pass through closure member 106 from a position above upper face 110, to a rotatable position below lower face 112, as shown. Rotation of protective cover 108 relative to closure member 106, while interlocking tabs 176 are below lower face 112, preferably misaligns peripheral notches 178 and interlocking tabs 176 and thereby removably retains protective cover 108 on closure member 106, as shown. Upon reading the teachings of this specification, those with ordinary skill in the art will now understand that, under appropriate circumstances, considering issues such as ease of manufacturing, required security, etc., other methods of retaining protective cover 108 on closure member 106 may suffice, such as, for example, screws, bolts, hinges, clasps, removable attachments, etc. A shallow recess 180 is preferably formed into lower face 112, adjacent to second lock aperture 152, to permit the shackle of a padlock to clear closure member 106 (as illustrated in FIG. 2).

As noted in the prior figures, closure member 106 preferably comprises adapter assembly 174 (at least herein embodying at least one size-adapter to adapt such at least one closure to at least two such well pipes having different sizes) to permit a single well cap system 100 to be adapted to several well casing 104 sizes (in the present application, the term "size" most preferably refers to a measured diameter of a well casing having a circular section). In a preferred arrangement, adapter assembly 174 comprises three mounting collars 114, permitting closure member 106 to be mounted to four different well casing sizes, as further described in FIG. 6 (at least herein embodying wherein such at least one size-adapter comprises at least one first one and at least one second one of such at least one mounts, such at least one first one being adapted to fit at least one such well pipe having a first size, and such at least one second one being adapted to fit at least one such well pipe having a second size different from such first size).

Figure 6:
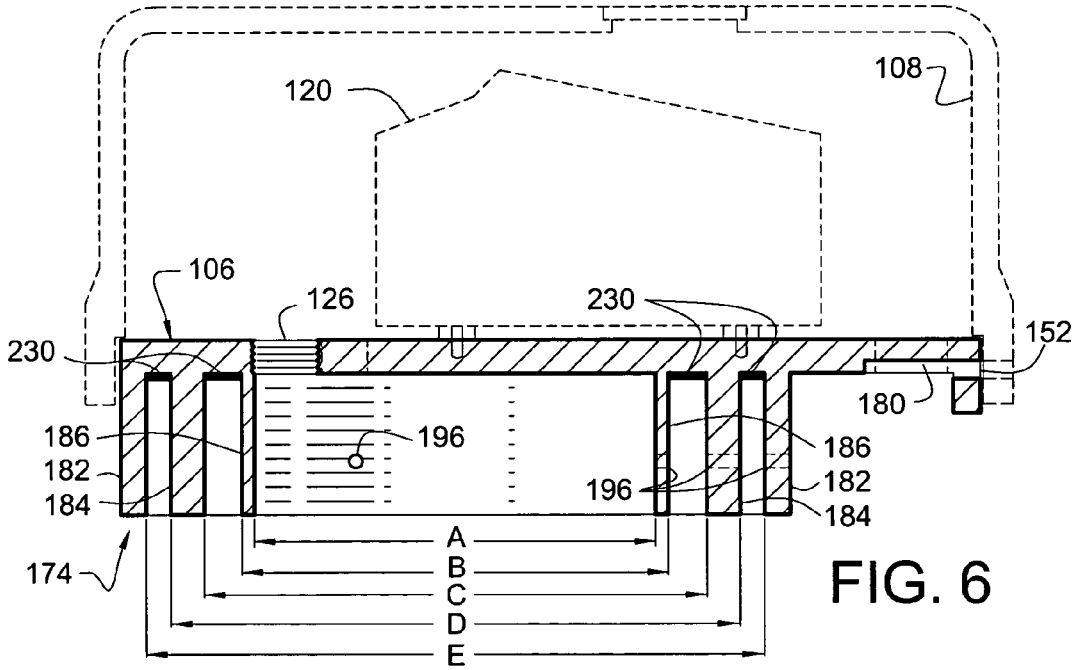
FIG. 6 is a sectional view through the section 6—6 of FIG. 4.

FIG. 6 is the sectional view 6—6 of FIG. 4 illustrating, in greater detail, the preferred arrangement of adapter assembly 174. Adapter assembly 174 preferably comprises outer collar 182, intermediate collar 184, and inner collar 186, as shown. Preferably, outer collar 182, intermediate collar 184, and inner collar 186 each comprise a generally cylindrical-shaped member having an inner diameter and an outer diameter, as shown. Preferably, the mounting collars 114 of adapter assembly 174 are concentrically nested, as shown.

Preferably, inner collar 186 has an interior diameter A of about 5.60 inches to permit inner collar 186 to fit over well casing 104, having a nominal diameter of about 5 inches (about 5.56 inches O.D.). Those with ordinary skill in the art, upon reading the teachings of this specification, will appreciate that the term "nominal" preferably refers to a pipe diameter or wall thickness, as specified, which may vary from the actual physical size. Preferably, inner collar 186 has an outer diameter B of about 5.96 inches to permit inner collar 186 to fit within interior portion 168 of well casing 104, having a nominal diameter of about 6 inches (about 6.065 inches I.D.). Preferably, intermediate collar 184 has an inner diameter C of about 7.02 inches to permit intermediate collar 184 to fit over well casing 104, having an outside diameter of about 7 inches. Intermediate collar 184 has a preferred outer diameter D of about 7.98 inches. Preferably, outer collar 182 has an inner diameter E of about 8.64 inches to permit outer collar 182 to fit over well casing 104 having a nominal diameter of about 8 inches (about 8.625 inches O.D.). Preferably, each mounting collar projects from lower face 112 about 2 inches, as shown. Upon reading the teachings of this specification, those with ordinary skill in the art will now understand that, under appropriate circumstances, considering issues such as well configuration, well casing size, etc., other mounting collar arrangements may suffice, such as, for example, use of collar sizes adapted to other well casing diameters both larger and smaller, adaptations to fit non-circular casings, use of adjustable banding clamps, etc. Preferably, mounting holes 196 are pre-drilled through each of the mounting collars 114, in concentrically aligned sets, each set positioned along a common axis, as shown. Preferably, the open areas between mounting collars 114 adjacent to lower face 112 may include an annular seal 230, as shown. Preferably, annular seal 230 comprises an adhesive-backed foam or rubber material having a thickness of about $1/8^{th}$ inch. Preferably, annular seal 230 permits lower face 112 to positively seal against the upper end of well casing 104, as shown.

Figure 7:
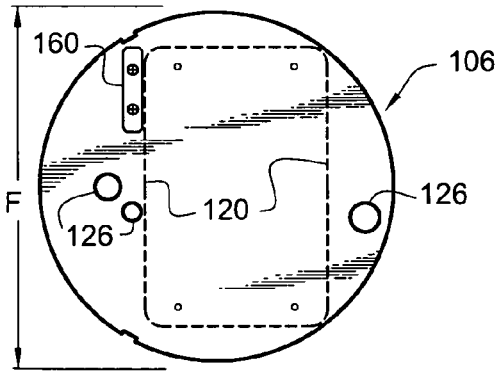
FIG. 7 is a top view of the base member, according to the preferred embodiment of FIG. 3A.

In reference to FIG. 7, with continued reference to the prior Figures, FIG. 7 is a top view of closure member 106, according to the preferred embodiment of FIG. 3A, illustrating a preferred arrangement of system components. Base member 106 has an outer diameter F of about one foot.

Preferably, well cap system 100 is constructed from one or more substantially rigid and durable materials. To reduce the risk of electrical shock, system 100 is preferably produced from a non-metallic material. Currently, it is most preferred that both closure member 106 and protective cover 108 be constructed from the same material, preferably a UV-stabilized thermoplastic, such as ABS (acrylonitrile butadiene styrene). Upon reading the teachings of this specification, those with ordinary skill in the art will now understand that, under appropriate circumstances, considering issues such as cost, harsh local well environments, etc., the use of other materials in the construction of the well cap system may suffice, such as, for example, PVC plastic, fiber-reinforced resins, stainless steel, aluminum, brass, etc.

Figure 8:
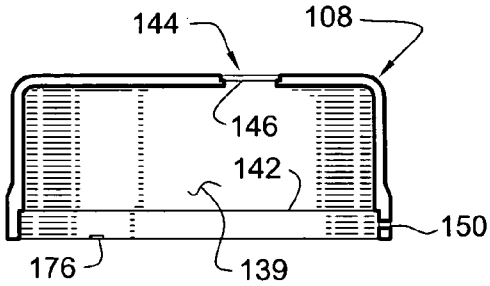
FIG. 8 is a sectional view through the section 8—8 of FIG. 4.

FIG. 8 is the sectional view 8—8 of FIG. 4 through protective cover 108. Preferably, protective cover 108 comprises a unitary moisture-resistant thermoplastic housing. Upon reading the teachings of this specification, those with ordinary skill in the art will now understand that, under appropriate circumstances, considering such issues as the strength characteristics of the selected fabrication materials, utilization of specialized housing configurations, etc., other wall thickness or dimensional arrangements from those illustrated below, may suffice, such as, for example, the incorporation of thinner or thicker material sections or use of selective areas of reinforcement. It is preferred that protective cover 108 comprises an average wall thickness of about 0.41 inch (using the preferred ABS thermoplastic material). Although it is preferred that only the closure member 106 comprise such features as threaded openings 126, controller 120 mountings and support, those of ordinary skill in the art, upon reading the teachings of this specification, will now appreciate that, under appropriate circumstances, protective cover 108 may include any or all of the above-mentioned features and components. Further, protective cover 108 may, under appropriate circumstances, comprise the outer housing of controller 120.

Figures 9, 10:
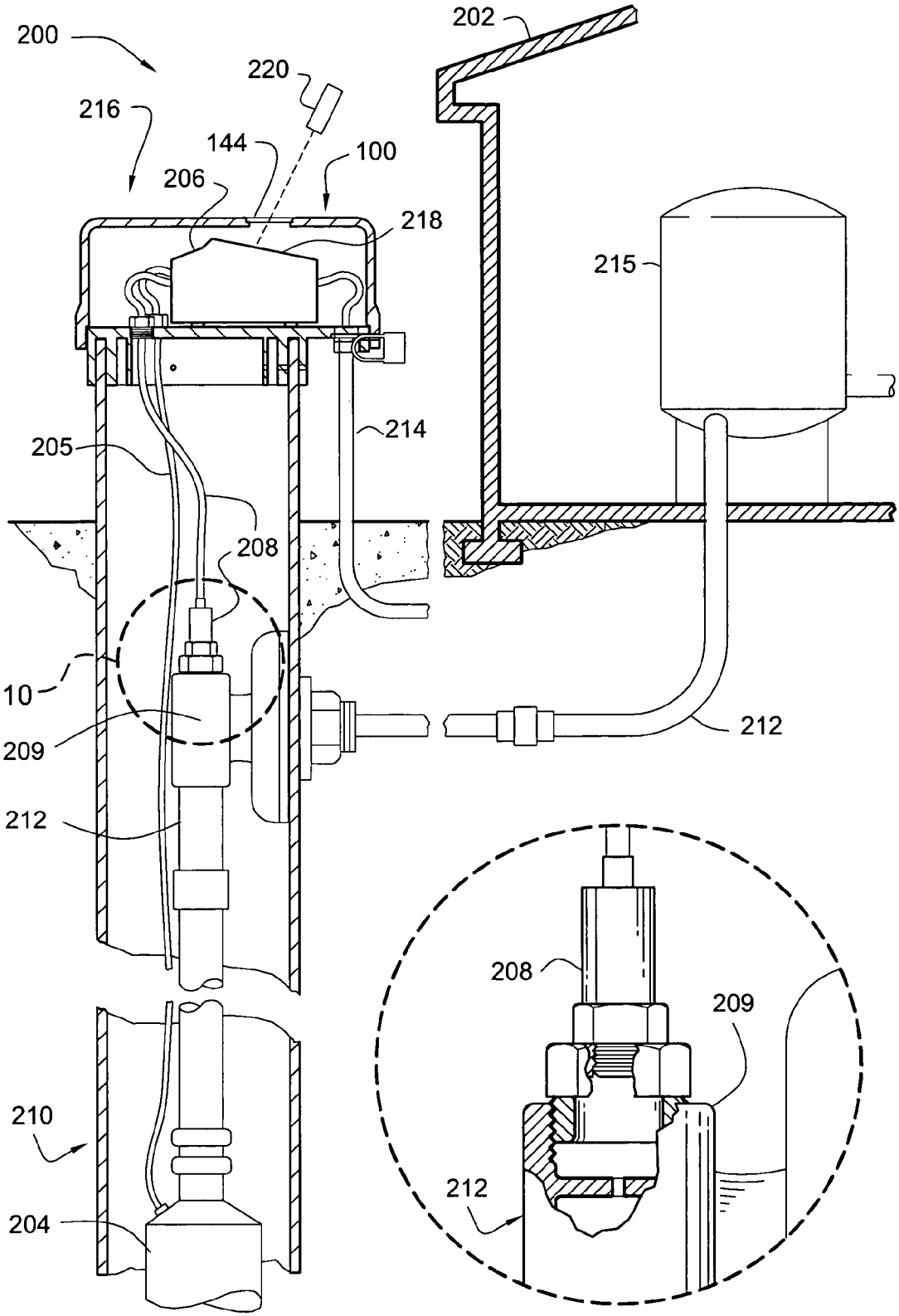
FIG. 9 is a diagrammatic sectional view through a well system supplying water to a structure such as building 202, according to a preferred embodiment of the present invention.
FIG. 10 is detail view 10 of FIG. 9 depicting, in partial section, a pressure detector used in conjunction with a local pump controller.

FIG. 9 is a diagrammatic sectional view through operating well system 200, supplying water to a structure shown as building 202, according to a preferred embodiment of the present invention. Well system 200 is preferably of a constant pressure type whereby water pressure is maintained within the system, regardless of the water demand, as shown. Preferably, well system 200 comprises; submersible pump 204, local pump controller 206, pressure detector assembly 208, power/control connection 205 and well cap system 100, as shown. Well system 200 may further comprise; water-well 210, water transfer piping 212 (to transfer water from submersible pump 204 to building 202 or other structure), pitless adapter 209, electrical supply 214, pressure tank 215 and, under appropriate circumstances, building 202 (or other structure having a pressurized water supply), as shown. Upon reading the teachings of this specification, those with ordinary skill in the art will now understand that, under appropriate circumstances, considering such issues as local codes and specific site requirements, the use of additional components within the well system may suffice, such as, for example, check-valves, test fittings, electrical and grounding connectors, splice boxes, electrical breakers, torque arresters/stop, etc.

Prior water-well installations typically locate the pump controller within building 202 (for example, within a utility room of a private residence). Monitoring and maintenance of prior systems has therefore required some level of access to such structure. Further, the use of prior constant pressure systems in new building construction has required that an appropriate level of construction be completed before the pump controller and related equipment can be installed.

Well system 200 overcomes the deficiencies of prior well systems by utilizing well cap system 100 to permit local control, monitoring and maintenance of the well system at well site 216, as shown. This arrangement reduces or eliminates issues, for closable structures restricting entry, of building access and availability (at least herein embodying wherein such at least one well and such at least one local control system are structured and arranged to permit maintenance of such system without entry to the at least one structure). Additionally, the requirement to route power/control connection 205 the extended distance from submersible pump 204 to a controller located in building 202 has been eliminated, as both local pump controller 206 and power supply 214 may be local to well site 216, as shown. It is noted that, the term "structure" shall include within its definition, a broad range of constructions and apparatus, such as, for example, occupiable buildings, remote livestock tanks, irrigation systems, drinking fountains, storage tank compounds, etc.; and the term "building" shall include within its definition only "structures" having restricted access and/or typically requiring permissions and/or appointments for access.

In preferred operation, a single local pump controller 206 (preferably supported within well cap system 100) receives electricity from power supply 214 and pressure data from pressure detector assembly 208, as shown. Local pump controller 206 is preferably preprogrammed to maintain a selected water pressure within the system. Local pump controller 206, by detecting a water pressure drop at pitless adapter 209, maintains the preset system pressure by regulating the output of submersible pump 204. Preferably, the pressurized water output from submersible pump 204 is directed through water transfer piping 212 to building 202, as shown. In most circumstances, the only required connection to building 202 is water transfer piping 212, as shown (at least herein embodying at least one water transfer system to transfer the flow of water from such at least one well to the at least one structure having at least one pressurized water supply).

Preferably, local pump controller 206 is a commercially-available variable frequency drive compatible unit (for example, control box model CU301 produced by Grundfos Pumps Corporation of Fresno Calif., U.S.A.). Preferably, local pump controller 206 comprises a selector and display panel 218 for system monitoring and adjustment. Preferably, selector and display panel 218 is conveniently viewable through view-port 144 (at least herein embodying wherein such at least one peripheral wall comprises at least one data transfer port to permit at least one transfer of data between the at least one local control system located within such at least one hollow cavity and at least one data device external to such at least one well cap; and at least herein embodying wherein such at least one transparent portion is structured and arranged to provide at least one signal view of at least one portion of the at least one local controller device even when such at least one protective cover is removably retained on such at least one base) from outside well cap system 100, as shown. Under appropriate circumstances, local pump controller 206 may include a hand-held infrared remote 220 (such as unit model R100 produced by Grundfos Pumps Corporation of Fresno Calif., U.S.A.), capable of retrieving pump and performance data by data exchange through view-port 144, as shown.

Preferably, submersible pump 204 is a high-efficiency variable frequency drive unit, preferably comprising a permanent-magnet motor with an output matched to the specific well application. Preferably, submersible pump 204 used in well system 200 is commercially available, and may be sourced from, for example, the SQE line of variable-frequency drive pumps produced by Grundfos Pumps Corporation (as noted above). Upon reading the teachings of this specification, those with ordinary skill in the art will now understand that, under appropriate circumstances, considering issues such as cost and availability, other manufacturers of pumps and controllers may suffice, such as, for example, Franklin Electric Company, Inc., Bluffton, Ind., U.S.A., or Goulds Pumps, ITT Industries, Seneca Falls, N.Y.

It is currently preferred that at least one pressure tank 215 or similar device be utilized within the system, as shown. Pressure tank 215 preferably serves to help regulate and maintain the system water pressure and reduces pressure fluctuations that occur during on-and-off cycling of submersible pump 204.

FIG. 10 is a detail view of detail 10 of FIG. 9 depicting, in partial section, pressure detector assembly 208 adapted to engage pitless adapter 209 (at least herein embodying wherein such at least one local pressure sensor is located within such at least one well pipe). Preferably, pressure detector assembly 208 (at least herein embodying at least one local pressure sensor for monitoring the pressure of the flow of water delivered from such at least one pump) is a solid state transducer having a threaded end that is adapted to engage a portion of water transfer piping 212, most preferably the top of pitless adapter 209, as shown.

Although applicant has described applicant's preferred embodiments of this invention, it will be understood that the broadest scope of this invention includes such modifications as diverse shapes and sizes and materials. Such scope is limited only by the below claims as read in connection with the above specification. Further, many other advantages of applicant's invention will be apparent to those skilled in the art from the above descriptions and the below claims.

What is claimed is:

1. A system for capping at least one well pipe having at least one upper opening and at least one interior portion containing at least one controllable apparatus, the at least one controllable apparatus controlled by at least one local controller device, said system comprising:

a) at least one well cap to cap the at least one well pipe;

b) wherein said at least one well cap comprises i) at least one closure adapted to substantially close the at least one upper opening, ii) at least one protective cover adapted to protectively cover the at least one local controller device, and iii) at least one support to support the at least one local controller device within said at least one protective cover;

c) wherein said at least one closure comprises at least one mount adapted to mount said at least one closure to the at least one well pipe;

d) wherein said at least one mount comprises at least one size-adapter to adapt said at least one closure to at least two such well pipes having different sizes; and e) wherein said at least one size-adapter comprises at least one first one and at least one second one of said at least one mounts, said at least one first one being adapted to fit at least one such well pipe having a first size, and said at least one second one being adapted to fit at least one such well pipe having a second size different from said first size.

2. The system according to claim 1 wherein said at least one size-adapter is adapted to fit said at least one closure to such at least one well pipe having a nominal diameter of five-inches.

3. The system according to claim 1 wherein said at least one size-adapter is adapted to fit said at least one closure to such at least one well pipe having a nominal diameter of six-inches.

4. The system according to claim 1 wherein said at least one size-adapter is adapted to fit said at least one closure to such at least one well pipe having an outer diameter of about seven inches.

5. The system according to claim 1 wherein said at least one size-adapter is adapted to fit said at least one closure to such at least one well pipe having a nominal diameter of eight-inches.

6. The system according to claim 1 wherein:

a) said at least one closure further comprises an essentially planar member having at least one first face, at least one second face, and a peripheral edge;

b) said at least one mount comprises at least one collar projecting outwardly from said at least one second face; and c) said at least one collar is adapted to engage at least one portion of the at least one well pipe.

7. The system according to claim 6 wherein said at least one closure comprises a nested arrangement of at least two of said at least one collars.

8. The system according to claim 6 wherein said at least one protective cover comprises:

a) at least one peripheral wall;

b) wherein said at least one peripheral wall defines at least one hollow cavity adapted to contain the at least one local controller device; and c) wherein said at least one peripheral wall comprises at least one access opening, having at least one inner peripheral edge, to permit access to said at least one hollow cavity.

9. The system according to claim 8 wherein said at least one well cap further comprises at least one electrical passage structured and arranged to assist passing of at least one electrical conductor from within said at least one hollow cavity to at least one point external to said at least one hollow cavity.

10. The system according to claim 9 wherein said at least one electrical passage comprises at least one threaded aperture.

11. The system according to claim 8 further comprising:

a) at least one first interlocker; and b) at least one second interlocker;

c) wherein said at least one second interlocker is adapted to interlock with said at least one first interlocker;

d) wherein said at least one first interlocker comprises said at least one closure;

e) wherein said at least one second interlocker comprises said at least one protective cover; and f) wherein interlocking of said at least one first interlocker and said at least one second interlocker provides a removable retention to removably retain said at least one protective cover to said at least one closure.

12. The system according to claim 11 wherein:

a) said at least one protective cover further comprises at least one first aperture adapted to pass at least one portion of at least one padlock shackle;

b) said at least one closure further comprises at least one second aperture to pass the at least one portion of the at least one padlock shackle; and c) such removable retention of said at least one protective cover adjacent said at least one closure by such interlocking permits at least one position of alignment between said at least one first aperture and said at least one second aperture to permit passage of the at least one portion of the at least one padlock shackle through both said at least one first aperture and said at least one second aperture.

13. The system according to claim 11 wherein said at least one peripheral wall comprises at least one data transfer port to permit at least one transfer of data between the at least one local controlling device within said at least one hollow cavity and at least one data transfer device external to said at least one well cap.

14. The system according to claim 12 wherein:

a) said at least one data transfer port comprises said at least one peripheral wall;

b) said at least one transparent portion is structured and arranged to provide at least one signal view of at least one portion of the at least one local controller device even when said at least one protective cover is removably retained on said at least one closure.

15. The system according to claim 11 wherein:

a) said at least one first interlocker comprises at least one peripheral notch formed within said at least one peripheral edge of said at least one closure;

b) said at least one second interlocker comprises at least one tab projecting from said at least one inner peripheral edge of said at least one protective cover;

c) said at least one peripheral notch is adapted to permit said at least one tab to pass through said at least one closure from a position adjacent said at least one first face to a position adjacent said at least one second face; and d) at least one rotation of said at least one protective cover relative to said at least one closure, while said at least one tab is in the position adjacent said at least one second face, removably retains said at least one protective cover on said at least one base member.

16. A system for capping at least one well pipe having at least one upper opening and at least one interior portion containing at least one controllable apparatus, the at least one controllable apparatus controlled by at least one local controller device, said system comprising:

a) at least one well cap to cap the at least one well pipe;

b) wherein said at least one well cap comprises i) at least one closure adapted to substantially close the at least one upper opening, ii) at least one protective cover adapted to protectively cover the at least one local controller device, and iii) at least one supported to support the at least one local controller device within said at least one protective cover, c) wherein said at least one well cap further comprises at least one vent to provide atmosphere venting between the at least one interior portion of the at least one well pipe and at least one environment exterior to the at least one interior portion of the at least one well pipe;

d) wherein said at least one vent comprises at least one channel to channel vented atmosphere from the at least one interior portion; and e) wherein said at least one channel comprises at least one isolator structured and arranged to isolate the atmospheric venting from the at least one local controller device.

17. A system for capping at least one well pipe having at least one upper opening and at least one interior portion containing at least one controllable apparatus, the at least one controllable apparatus controlled by at least one local controller device, said system comprising:

a) at least one well cap to cap the at least one well pipe;

b) wherein said at least one well cap comprises i) at least one closure adapted to substantially close the at least one upper opening, ii) at least one protective cover adapted to protectively cover the at least one local controller device, and iii) at least one support to support the at least one local controller device within said at least one protective cover;

c) wherein said at least one well cap substantially comprises at least one thermoplastic material.

18. A system, for supplying a flow of water from at least one well having at least one well pipe, at least one upper well pipe opening and at least one pipe interior to at least one structure having a pressurized water supply, said system comprising, in combination:

a) at least one pump to pump water from the at least one pipe interior;

b) at least one local controller to control said at least one pump; and c) at least one well cap, comprising at least one internal hollow, to cap the at least one upper well pipe opening;

d) wherein said at least one local controller is located essentially within said at least one internal hollow of said at least one well cap.

19. The system according to claim 18 wherein said at least one local controller comprises at least one local pressure sensor adapted to monitor the pressure of the flow of water delivered from said at least one pump.

20. The system according to claim 19 further comprising such at least one well having at least one well pipe.

21. The system according to claim 20 wherein said at least one local pressure sensor is located within said at least one well pipe of said at least one well.

22. The system according to claim 21 further comprising at least one water transferor to transfer the flow of water from said at least one well to the at least one structure having at least one pressurized water supply.

23. The system according to claim 22 further comprising such at least one structure having at least one pressurized water supply.

24. The system according to claim 20 wherein said at least one well and said at least one local controller are structured and arranged to permit maintenance of said system without entry into the at least one structure.

25. The system according to claim 20 wherein said at least one local controller comprises the sole controller of said at least one pump within said system.

* * * * *